US005953819A

United States Patent [19]

Simms et al.

[11] Patent Number: 5,953,819

[45] Date of Patent: Sep. 21, 1999

[54] RAZORS

[75] Inventors: Graham John Simms, Reading; Oliver David Oglesby, Basingstoke, both of United Kingdom

[73] Assignee: The Gillette Company, Boston, Mass.

[21] Appl. No.: 08/875,190

[22] PCT Filed: Feb. 2, 1996

[86] PCT No.: PCT/US96/01300

§ 371 Date: Sep. 25, 1997

§ 102(e) Date: Sep. 25, 1997

[87] PCT Pub. No.: WO96/24469

PCT Pub. Date: Aug. 15, 1996

[30] Foreign Application Priority Data

Feb. 6, 1995 [GB] United Kingdom ..... 9502268

[51] Int. Cl.[6] ..... B26B 19/42

[52] U.S. Cl. ..... 30/34.2; 30/77; 30/82

[58] Field of Search ..... 30/34.2, 77, 81, 30/82, 537

[56] References Cited

U.S. PATENT DOCUMENTS

| | | | |
|---|---|---|---|
| 3,116,550 | 1/1964 | De-Paoli | 30/34.2 |
| 3,871,073 | 3/1975 | Nissen et al. | 30/34.2 |
| 3,909,939 | 10/1975 | Dootson | 30/34.2 |
| 4,044,463 | 8/1977 | Tietjens | 30/34.2 |
| 4,189,832 | 2/1980 | Harper et al. | 30/34.2 |
| 4,720,917 | 1/1988 | Solow | 30/49 |
| 4,741,103 | 5/1988 | Hultman | 30/34.2 |
| 5,067,238 | 11/1991 | Miller et al. | 30/34.2 |
| 5,249,361 | 10/1993 | Apprille, Jr. et al. | 30/34.2 |
| 5,416,973 | 5/1995 | Brown et al. | 30/34.2 |
| 5,475,923 | 12/1995 | Ferraro | 30/51 |
| 5,802,721 | 9/1998 | Wain et al. | 30/34.2 |

FOREIGN PATENT DOCUMENTS

| | | | |
|---|---|---|---|
| 0366139 | 5/1990 | European Pat. Off. . | |
| 2069398 | 8/1981 | United Kingdom . | |
| 9205926 | 3/1992 | WIPO . | |
| 95/29043 | 2/1995 | WIPO | B26B 21/40 |

*Primary Examiner*—M. Rachuba
*Attorney, Agent, or Firm*—Edward S. Podszus

[57] ABSTRACT

A skin contacting member for a razor or like shaving device. In use, the skin contacting member is located ahead of a blade or blades of the razor. The skin contacting member has channels formed by stiff wall segments that extend perpendicular to the blade cutting edge for the passage of hairs, and resilient lateral portions that extend into the channel forming narrow regions that engage and pull the hairs passing through the channels in advance of the blades.

25 Claims, 4 Drawing Sheets

RAZORS

BACKGROUND OF THE INVENTION

This invention relates to razors. It is particularly concerned with a skin contacting member for influencing hair protrusion ahead of a blade of a safety razor moving across the skin surface.

SUMMARY OF THE INVENTION

In accordance with the invention there is provided a skin contacting member in or for a shaving device, comprising elements spaced apart to define channels for passage of hairs, the elements having lateral parts extending laterally into the channels for engaging and pulling hairs passing through the channels, said lateral parts being deflectable by resilient deformation to enable a hair to pass through a channel without the elements defining said channel being displaced to restrict an adjacent channel.

One embodiment of a skin contacting member described herein comprises a series of spaced upstanding elements defining channels therebetween for passage of hairs in a direction from front to rear of the member, and resiliently flexible lateral parts projecting laterally from said elements into said channels for engaging hairs to impart thereon pulling forces opposing movement through the channels. In a presently preferred form of this embodiment the upstanding elements comprise substantially rigid parallel walls. These walls have resilient laterally projecting parts in the form of flaps with slightly tapering cross-sections and inclined rearwardly in the direction away from the walls. A plurality of flaps are provided on each side of a wall, and the spacing between the free upright edges of opposed pairs of flaps in a channel gradually reduces to provide an increasing pulling force on a hair as it moves through a channel.

The invention includes a razor blade unit, such as a replaceable shaving cartridge, having a skin contacting member embodying the invention. The skin contacting member may define a guard surface for contacting the skin in front of the blade edge(s) during shaving. Alternatively, the skin contacting member could be positioned between two blades in a blade unit having two or more blades.

A better understanding of the invention will be had from the following detailed description, reference being made to the accompanying drawings.

DETAILED DESCRIPTION OF PREFERRED EMBODIMENTS

Figure 1:
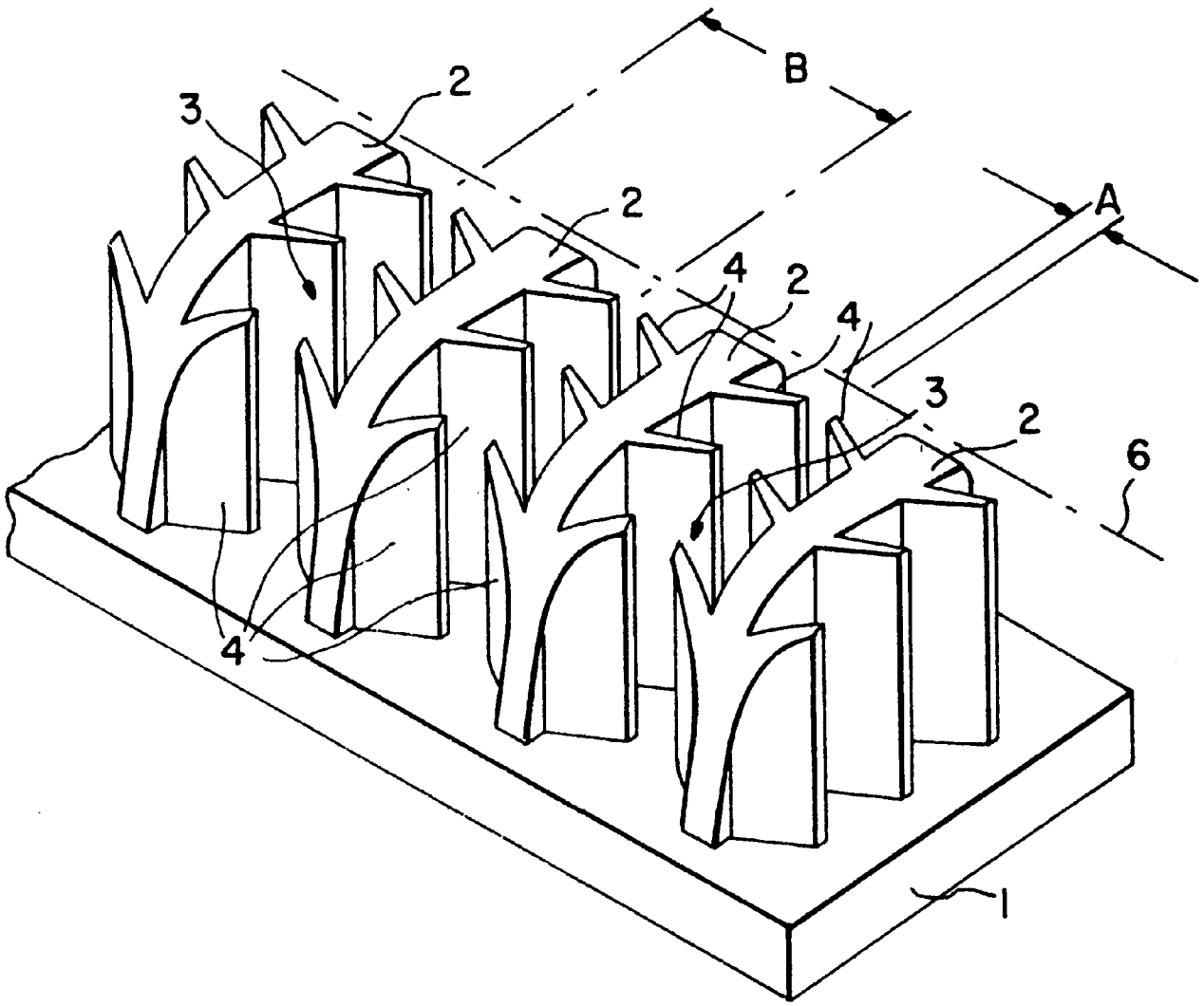
FIG. 1 shows schematically a longitudinal section of a skin contacting member embodying the invention.

The skin contacting member illustrated in FIG. 1 is a unitary plastics structure with an elongate base 1 shown to have a rectangular configuration, but this is unimportant. Extending upwardly from the base is a series of uniformly spaced elements consisting of parallel walls 2 confining between them parallel channels 3 running from front to rear of the member. The tops of the walls 2 define the skin contacting surface of the member, and with a view to improving comfort the upper front edges of these walls are rounded off. Projecting into each channel 3 from the adjacent walls are pairs of laterally opposed resilient parts in the form of wings or flaps 4. Each flap has an upright free edge, tapers in cross-section towards the free edge from the wall to which it is attached, and is inclined rearwardly at an acute angle to this wall. Due to this inclination the opposed pairs of flaps act to guide or funnel hairs towards the openings formed between their free edges. The width of the openings between the pairs of flaps in each channel diminishes progressively in the direction from front to rear along the channel. At least the rearmost pair of flaps define an opening with a width A which is less than the diameter of a hair so that the extremities of these flaps are deflected rearwardly as a hair passes through the channel and as a consequence the hair is subjected to a pulling force due to the friction of the flaps rubbing against it. Pulling the hair in this way can temporarily increase the hair length protruding from the skin surface at a position immediately in front of a razor blade edge 6 so that a close shave may result. The pulling force exerted on a hair will be determined by the resilience of the flaps as well as the initial spacing A between their edges, and these will be chosen so that a force sufficient to achieve hair extension without causing discomfort are obtained. If the flaps are made sufficiently flexible the normal spacing between the flap edges could be very small, or even zero. The pitch B between the centre lines of the channels is preferably made as small as possible without risking integrity of the structure so that the majority of hairs pass through the channels as the skin from which they protrude slides over the upper surface of the skin contacting member. The height of the walls and the flaps is not critical, but should be at least the diameter of a hair.

It should be understood that the described skin contacting member is an exemplary embodiment of the invention only and modifications are possible without departing from the scope of the claims. For example, in each channel resilient flaps might be provided on only one of the walls confining the channel. If a narrow member is desired, e.g. for location between two blades in a razor blade unit, two pairs or just a single pair of flaps could be provided in each channel.

Figure 2:
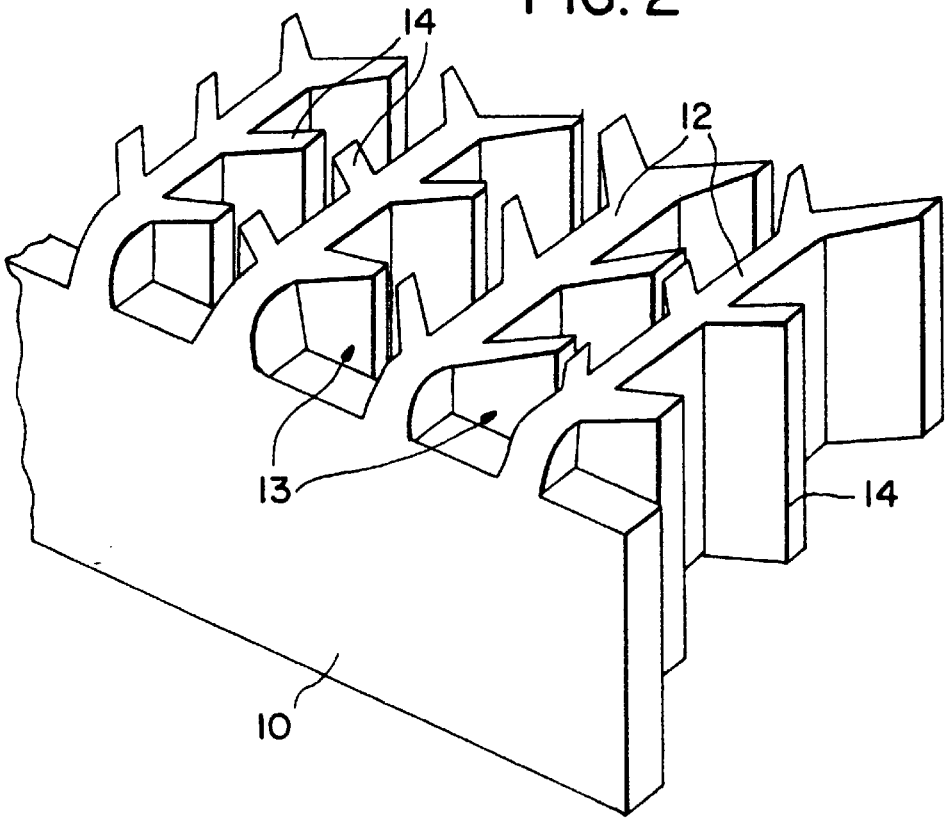
FIGS. 2 and 3 show respective modified forms of the member showing in FIG. 1.

In the modified skin contacting member illustrated in FIG. 2, rather than being carried on a base the parallel walls 12 defining the channels 13 are formed integrally with a bar or plate 10 extending along the front of the member and from which the walls extend rearwardly. Otherwise the member of this embodiment can be as described in connection with the first embodiment. The walls 12 and the flaps 14 suitably extend to a height of about 0.1 mm above the height of the top edge of the bar 10.

Figure 3:
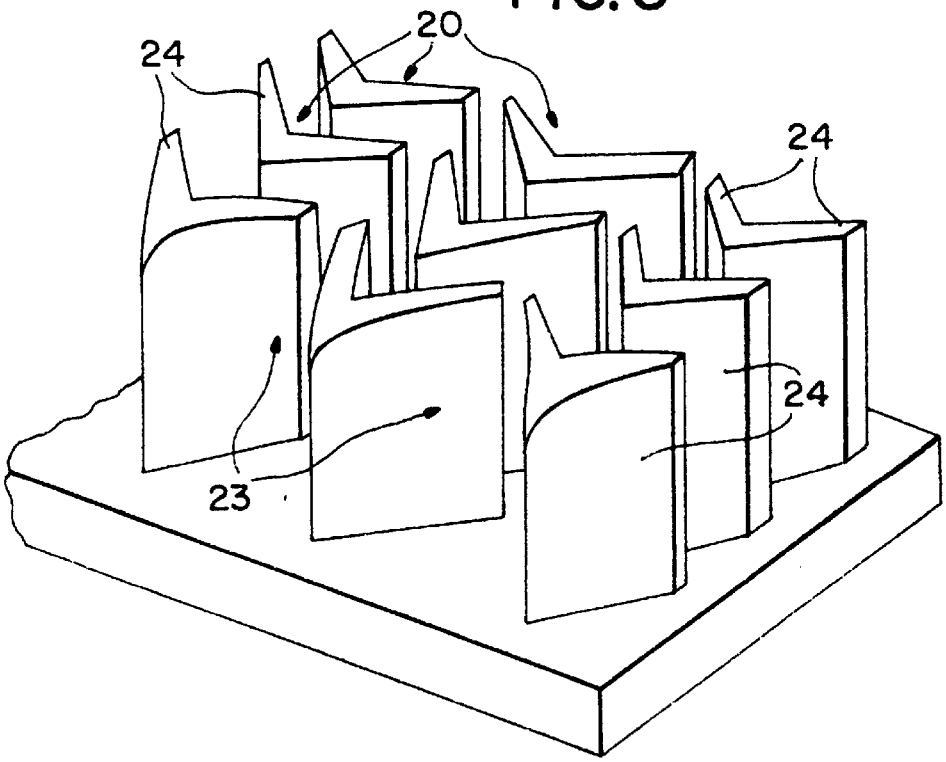

The modified skin contacting member of FIG. 3 has separate elements 20 defining respective pairs of lateral parts in the form of resiliently flexible flaps 24 directed generally oppositely into adjacent channels 23. The flaps, which are otherwise arranged as in the embodiments of FIGS. 1 and 2, act to exert a light pulling force on the hairs passing through the channels in the same way as they do in the previous embodiments. The individual elements 20 may undergo a degree of flexing in the rearward direction under the forces exerted by the skin during shaving although this is not essential and will not impair the hair pulling effect of the flaps if it does occur.

Figure 4:
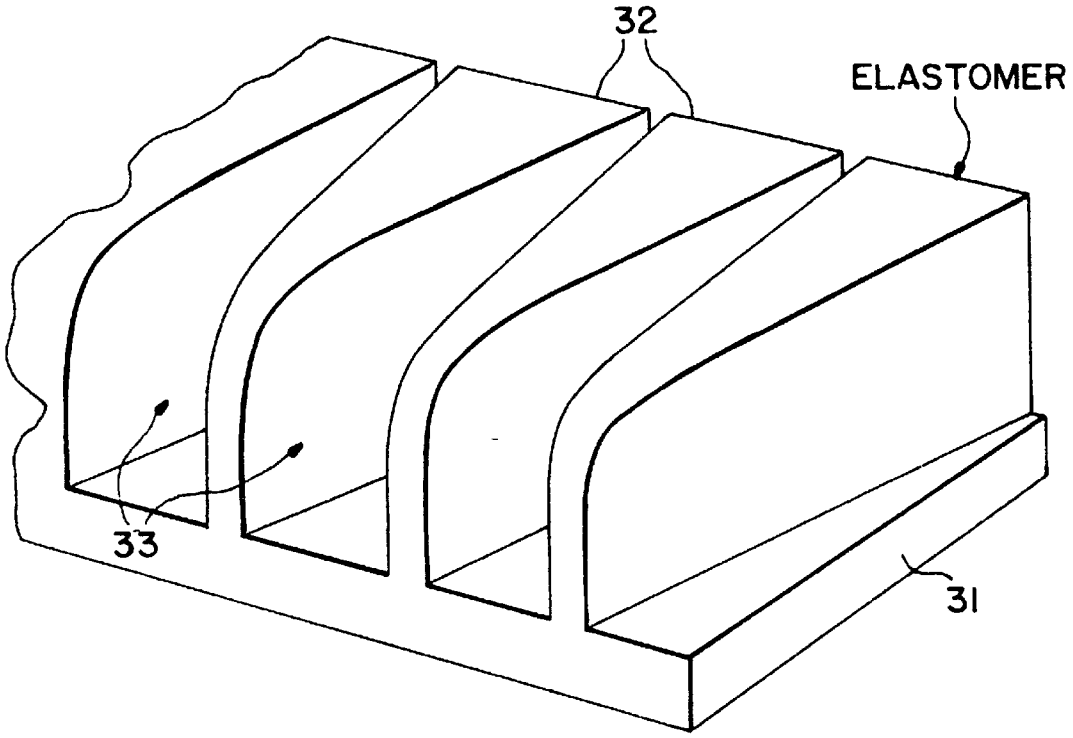
FIGS. 4 and 5 are similar views to FIG. 1 showing alternative embodiments of skin contacting members in accordance with the invention.

The skin contacting member illustrated in FIG. 4 is made of elastomer and has generally parallel walls 32 upstanding from and formed integrally with a base 31. These walls have straight central portions and on either side thereof wedge shaped lateral parts formed integrally with the central portion and defining laterally inclined upright flanks whereby the channels 33 defined between the walls 32 taper from front to rear of the member. The hairs passing through the channels are able to deflect the sidewalls of the channel, due to the resiliently compressible nature of the material forming the lateral parts of the walls 32, so that they can pass through the rear end portions of the channels although the channel width is less than the hair diameter while experiencing a light pulling force acting to draw the hairs from the skin which is sliding over the surface defined by the top faces of the walls 32.

Figure 5:
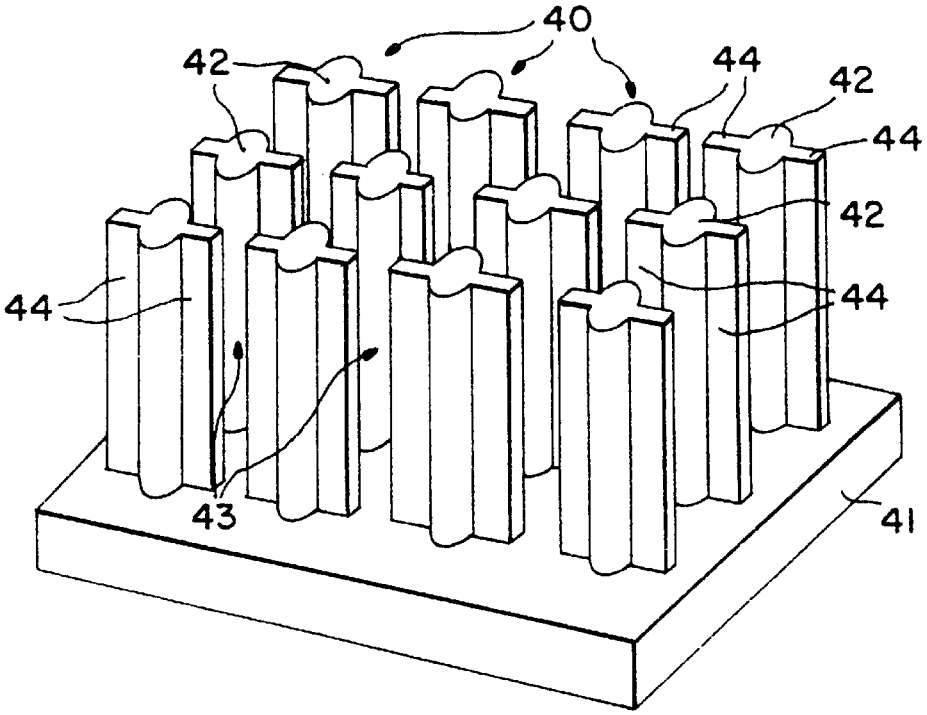

FIG. 5 shows an embodiment of the invention in which channels 43 are defined by upstanding elements 40 integral with a base 41 and in the form of posts 42 with laterally projecting parts in the form of flaps 44. The flaps are arranged in opposed pairs and can be resiliently deflected by hairs passing along the channels 43 due to the posts 42 undergoing torsional twistings about their axes. In this manner the flaps are adapted to exert a light pulling force on the hair. The elements 40 of this embodiment may be capable of flexing rearwardly under the forces encountered during shaving, but as mentioned above in relation to the FIG. 3 embodiment, such flexing is not essential to nor will it detract from the hair pulling effect of the element.

In the embodiments of FIGS. 1–3, it is not essential for the flaps to be arranged in opposed pairs. They can be offset along the channels provided their edges are positioned so that the desired pulling forces are still applied to hairs passing along the channel. Similarly, it is not crucial for the flaps in these embodiments to be rewardly inclined and they could be substantially perpendicular to the length of the channel, or perhaps be forwardly inclined towards their free edges.

Figure 6:
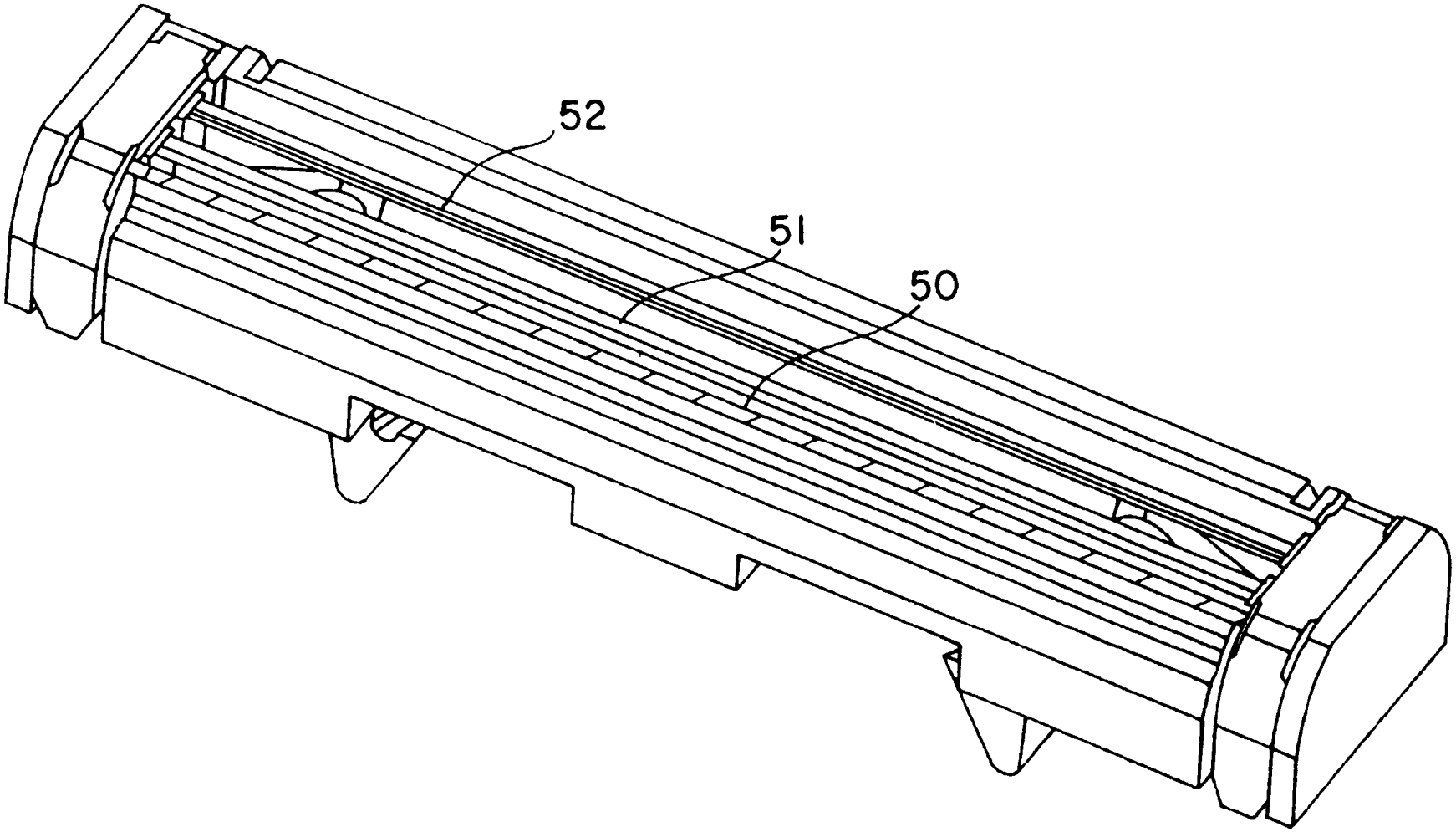
FIG. 6 is a perspective view of a shaving cartridge incorporating a skin contacting member according to the invention.

FIG. 6 shows a shaving cartridge equipped with a skin contracting member 50 in accordance with the invention. The skin contracting member 50 is illustrated only schmatically but it could take the specific form of any one of the embodiments of FIGS. 1 to 5. Apart from the skin contracting member 50, the cartridge is of a known construction. As shown it includes two parallel blades 51, 52 carried by a frame between guard and cap. The skin contacting member 50 is shown positioned immediately in front of the cutting edge of the first blade 51, but a skin contacting member according to the invention could additionally or alternatively be located between the blades for pulling hairs directly in front of the second blade 52.

We claim:

1. A shaving unit comprising an elongate skin engagement member for contacting the skin in advance of a cutting element moved across the skin during shaving, said skin engagement member being defined by a series of elements having stiff central wall portions and resilient lateral portions, the central wall portions defining channels therebetween that are arranged for hairs to pass therethrough, the central wall portions resisting displacement in response to lateral forces tending to deflect the central wall portions to restrict adjacent channels, the lateral portions extending from the central wall portions into the channels and having upstanding free end walls located in the channels, wherein lateral portions extend from opposed adjacent central wall portions towards each other to define between their free end walls an open region within each channel for the passage of hairs, the adjacent lateral portions being formed and spaced apart along the channel to engage resiliently the hairs passing through the channel for applying a light pulling force to the hairs as the skin from which the hairs project slides over the skin engagement member, and wherein each of the channels extends from a mouth at a leading edge of the skin engagement member to a trailing edge thereof proximate the cutting element, the width of the open region within each channel defining, between at least one pair of free end walls rearward from the mouth thereof, a minimum value less than the diameter of a hair, and the adjacent lateral portion free end walls being resiliently movable away from a centerline of the channel in the lateral direction transverse to the channel in response to passage of the hairs through the channel while substantially not deflecting the central wall portions transversely towards adjacent channels, hairs passing through the channels being gripped between the adjacent lateral portions to extend the hairs from the skin and the hairs being released at the trailing edge of the skin engaging member to meet the cutting element before retracting into the skin.

2. A shaving unit according to claim 1, wherein the width of the open region within the channel tapers rearwardly from the mouth thereof to the trailing edge.

3. A shaving unit according to claim 1, wherein the elements are integrally formed with a carrier.

4. A shaving unit according to claim 3, wherein the carrier is a base from which the elements extend upwardly.

5. A shaving unit according to claim 1, wherein the central wall portions are substantially parallel.

6. A shaving unit according to claim 1, wherein lateral portions are disposed in opposed pairs at substantially the same location along the central wall portions.

7. A shaving unit according to claim 1, wherein opposed adjacent lateral portions are offset along the channel.

8. A shaving unit according to claim 1, wherein the central wall portions are substantially uninterrupted from the leading edge to the trailing edge along each channel.

9. A shaving unit according to claim 1, wherein the elements have wedge-shaped lateral portions defining inclined lateral surfaces on either side of each central wall portion, the lateral portions being formed of a resiliently compressible material.

10. A shaving unit according to claim 1, wherein the cutting element is a sharpened blade edge.

11. A shaving unit according to claim 1, wherein the resilient lateral portions comprise a plurality of flaps projecting into the channels and having upwardly directed free edges.

12. A shaving unit according to claim 1, wherein the lateral portions are rearwardly inclined towards the channel trailing edge.

13. A shaving unit according to claim 1, wherein the lateral portions taper from the central wall portions towards their free end walls.

14. A shaving unit according to claim 1, wherein the lateral portion free end walls are substantially upright and generally perpendicular to an upper skin contacting surface of the elements.

15. A shaving unit according to claim 1, wherein the central wall portions comprise posts and the lateral portions comprise flaps that are deflectable under torsion of the posts.

16. A shaving unit according to claim 11, wherein the elements comprise respective pairs of resiliently flexible flaps directed to project into adjacent channels.

17. A shaving unit according to claim 11, wherein the central wall portions are substantially parallel.

18. A shaving unit according to claim 11, wherein the flaps are laterally rearwardly inclined towards their free edges.

19. A shaving unit according to claim 11, wherein the flaps taper towards their free edges.

20. A shaving unit according to claim 11, wherein the central wall portions are substantially uninterrupted from the leading edge to the trailing edge along each channel.

21. A shaving unit according to claim 11, wherein the flaps are arranged in opposed pairs in each channel.

22. A shaving unit according to claim 1, wherein there is a plurality of opposed pairs of flaps in each channel.

23. A shaving unit according to claim 22, wherein the width of the open region between the plurality of opposed flap pairs within the channel tapers rearwardly from the mouth thereof to the trailing edge.

24. A shaving unit according to claim 1, wherein the skin engagement member occupies a position of a guard in advance of a first cutting element.

25. A shaving unit according to claim 1 and having a plurality of generally parallel cutting elements, wherein the skin engagement member is positioned between a first and a second cutting element.

* * * * *